US005960873A

United States Patent [19]

Alexander et al.

[11] Patent Number: 5,960,873

[45] Date of Patent: Oct. 5, 1999

[54] PRODUCING FLUIDS FROM SUBTERRANEAN FORMATIONS THROUGH LATERAL WELLS

[75] Inventors: Steve L. Alexander, Aberdeen, United Kingdom; Michael R. Chambers, Bedford; Samuel L. Pickett, Midland, both of Tex.

[73] Assignee: Mobil Oil Corporation, Fairfax, Va.

[21] Appl. No.: 08/931,321

[22] Filed: Sep. 16, 1997

[51] Int. Cl.[6] ..... E21B 7/08

[52] U.S. Cl. ..... 166/50; 166/117.6; 166/242.1

[58] Field of Search ..... 166/50, 117.6, 166/242.3, 242.5, 242.1, 313

[56] References Cited

U.S. PATENT DOCUMENTS

| | | | |
|---|---|---|---|
| Re. 33,150 | 1/1990 | Boyd | 166/242.5 |
| 2,397,070 | 3/1946 | Zublin . | |
| 2,797,893 | 7/1957 | McCune et al. . | |
| 3,330,349 | 7/1967 | Owsley et al. | 166/313 |
| 3,349,845 | 10/1967 | Holbert et al. . | |
| 4,415,205 | 11/1983 | Rehm et al. | 166/50 |
| 4,807,704 | 2/1989 | Hsu et al. . | |
| 5,115,872 | 5/1992 | Brunet et al. | 175/61 |
| 5,353,876 | 10/1994 | Curington et al. . | |
| 5,655,602 | 8/1997 | Collins . | |
| 5,680,901 | 10/1997 | Gardes | 166/313 |

*Primary Examiner*—Hoang Dang
*Attorney, Agent, or Firm*—Malcolm D. Keen

[57] ABSTRACT

Method and apparatus for producing fluids from a production zone(s) by drilling and completing multiple laterals from primary wellbore. One or more pre-formed window units are provided in a casing string before it is cemented in the well. Each unit is comprised of a housing having an inlet and two outlets, one of which forms the pre-formed window. The axes of the two outlets forms a relatively small angle (e.g. from 1° to about 10°, preferably 3°) whereby a well string will follow a gently curved path as it exits through the window. A re-entry line from the surface can be attached to the housing so that a work-over string can be lowered into a selective lateral without having to shut-in production from the other laterals.

7 Claims, 4 Drawing Sheets

PRODUCING FLUIDS FROM SUBTERRANEAN FORMATIONS THROUGH LATERAL WELLS

DESCRIPTION

1. Technical Field

The present invention relates to producing fluids from subterranean formations through lateral wellbores and in one of its aspects relates to a method and apparatus for producing fluids from subterranean production zones by drilling and completing multiple, substantially horizontal lateral wellbores through pre-formed "windows" in a well casing which has been cemented in a primary, substantially vertical wellbore.

2. Background

In producing hydrocarbons or the like from certain subterranean formations, it has now become fairly routine to drill one or more horizontal wellbores, sometimes called drainholes or "laterals", into the producing formation from a primary, substantially vertical wellbore. As recognized in the art, these laterals extend outward from the primary wellbore and into the formation thereby substantially increasing the effective drainage area around the primary well. Further, the production fluids (e.g. hydrocarbons) can flow from the outer regions of the formation directly into these laterals which, in turn, provide relatively, unrestricted flowpaths for these fluids back into the primary wellbore from which they then are produced to the surface.

Several techniques have been proposed for drilling and completing laterals from both open-hole and from cased primary wells. For example, in open-hole completions, a whipstock or the like is merely positioned in the primary well to divert a drill string through a curved path to drill the desired lateral(s); e.g. see U.S. Pat. Nos. 3,349,845 and 3,398,804.

In cased wells, the laterals are drilled through "windows" which are provided in the casing at points adjacent the "kick-off" points for the respective laterals. These windows are typically "milled" through the casing after the casing has been cemented in the primary wellbore; e.g. see U.S. Pat. No. 4,807,704. However, the milling of these windows is both time-consuming and equipment intensive and may be difficult to successfully accomplish in some instances; all thereby adding substantially to the costs involved in this type of completion.

It has also been proposed to "pre-form" the windows in the casing before the casing is run into the primary wellbore. One such technique is disclosed in U.S. Pat. No. 2,797,893 wherein "windows" or openings are pre-formed in a liner before the liner is lowered into and suspended from the lower end of the well casing. Unfortunately, the profile (i.e. perimeter of the actual opening through the casing) formed by these "pre-formed windows" is basically the same as the profile formed when the windows are milled after the casing has been cemented in the well. That is, the profile of the openings (i.e. windows) for both milled and pre-formed windows is a typically elongated oval as viewed from the side of the casing.

This irregular profile of the respective windows makes it extremely difficult to seal the juncture between the casing and a typical completion liner, e.g. slotted liner, which is normally run through the window and into the lateral after the lateral has been drilled. As is well known in the art, a good seal is necessary at this juncture to prevent the fluids being produced through the lateral from leaking in behind the casing as they enter the primary wellbore and causing the problems commonly associated with such leakage.

Recently, it has been proposed to provide pre-formed windows in a casing string wherein the windows will have a more-sealable profile. This is done by installing an inverted, Y-shaped housing at each point in the casing at which a lateral is to be drilled; see U.S. Pat. No. 5,353,876. The outlet of one leg of each Y-shaped housing cooperates with the inlet of the housing to provide a continuation of the flow passage through the casing while the outlet of the other leg provides the "window" or exit through which a lateral is to be drilled and completed. The window has a substantially circular profile which, in turn, provides a good mating surface for sealing with a circular completion liner when the liner is passed through the window and into the lateral.

Unfortunately, however, the axis of the leg of the Y-shaped housing which forms the window is substantially parallel to the longitudinal axis of the casing string thereby dictating that the drill and/or liner must exit through the window in a substantially vertical, downward direction. This, added to the fact that each of these housings are short and compact in length, necessitates that the drill/liner to undergo at least two, relatively sharp curvatures in order to exit the "window" in the required vertical, downward direction. As will be recognized in the art, this requires an extreme manipulation of these well strings and may be difficult to accomplish in many instances.

Still further, since the drill/liner exits the housing in a substantially vertical direction, an external diverter must be attached to the housing below the exit opening in order to "kick-off" the well string into the required curved path after the well string has exited the housing. This, too, can add substantially to the costs involved both in the making-up and installing of the casing and in carrying out the drilling and completion of the laterals through the Y-shaped housings.

Also, where multiple laterals are completed from a single primary wellbore, the entire production from the well has to be shut-in whenever it becomes necessary to re-entry any of the laterals to run a production log or to carry out work-over operations. That is, production from the primary wellbore (hence production from all of the laterals) has to be stopped in order to re-enter any one of the laterals. This, again, is time-consuming and the lost production during this time can seriously, adversely affect the overall economics of the well. Therefore, it is desirable to re-enter any one of the multiple laterals to work-over that lateral without first having to shut-in the production from the primary wellbore and that from all of the other multiple laterals.

SUMMARY OF THE INVENTION

The present invention provides a method and apparatus for producing fluids from a subterranean production zone(s) by first drilling a primary wellbore through said production zone and then lowering a special casing string therein. The casing string has one or more pre-formed window units therein which are assembled into the casing string as it is made-up and lowered into the primary wellbore. Each pre-formed window unit has a pre-formed window therein which is to be positioned below a respective production zone when the casing string is in an operable position within the primary wellbore. The casing string is cemented in the well and a lateral is drilled and completed through each of the windows. By positioning the window below the production zone, gravity aids in producing the fluids back through the lateral and into the primary wellbore where the fluids are co-mingled and produced to the surface.

More specifically, the present invention provides a method and apparatus for drilling and completing a lateral wellbore from a primary wellbore wherein the apparatus includes a casing string adapted to be lowered and cemented into said primary wellbore. The casing string has at least one pre-formed window unit therein, which, in turn, is comprised of an elongated housing having an inlet at its upper end and two outlets at its lower end, said inlet and a first of said two outlets being fluidly connected into said casing string to provide a continuous flowpath through the casing string.

The other of said two outlets in the housing provides a pre-formed window for drilling and completing a lateral wellbore from the primary wellbore. The longitudinal axis which extends through the center of said first outlet lies on or is substantially parallel to the longitudinal axis of said casing string while the longitudinal axis extending through the center of said second outlet forms a relatively small angle (e.g. from 1° to about 10°, preferably 3°) with respect to longitudinal axis of said first outlet. This small angle of deflection allows a well string to follow a gentle curvature as it exits the casing through the window.

In one embodiment, a re-entry line is attached to the housing of each pre-formed window unit and extends to the surface. This line is in fluid communication with the interior of its respective housing and has an effective longitudinal axis which is in substantial alignment with the center of the pre-formed window when said string of casing and said re-entry line are in an operable position (i.e. cemented) within said primary wellbore. This allows a logging tool and/or a work-over string (e.g. coiled tubing with a washing jet thereon) to be lowered down the re-entry string and into a respective lateral wellbore without having to shut-in production from the other laterals.

A landing sub is connected to the first outlet in said housing and is adapted to releasably receive a diverter which is adapted to deflect a well string through a small angle and out the pre-formed window. A liner connector sub is connected to the window outlet and has means thereon for receiving and latching a completion liner thereto after the liner has passed through the window and into the lateral.

In operation, the casing string is made-up and cemented in the primary wellbore. A diverter is lowered through the casing and is manipulated into the landing sub on a selected pre-formed window unit. A drill string (e.g. coiled tubing with a bent-sub and downhole motor) is deflected out through the window to drill a lateral. The bent-sub and motor is steered so that the lateral curves upwards into the production zone and then extends horizontal outward therein. Next, the drill string is withdrawn and a production liner string is deflected into the lateral to complete the well.

The diverter is then moved to another pre-formed window unit where the operation is repeated to drill and complete another lateral from the primary wellbore. When all of the desired laterals have been completed, the diverter is removed and production from all of the laterals flow into a sump within the primary wellbore where they are co-mingled to be produced to the surface.

By providing a pre-formed window in the casing string which allows a well string to exit in a gentle curvature, the string(s) do not have to be subjected to any severe bending and no external diverter is required to redirect the string once it has exited from the casing. Further, by locating the window (i.e. kick-off point for the lateral) below the producing zone, the zone is still able to produce even where the pressure in the zone is close to that in the primary wellbore. Still further, by providing an individual re-entry line to each of the pre-formed window units, any one of the laterals can be re-entered without requiring that the production from the other laterals be shut in.

BRIEF DESCRIPTION OF THE DRAWINGS

The actual construction, operation, and apparent advantages of the present invention will be better understood by referring to the drawings, not necessarily to scale, in which like numerals identify like parts and in which.

BEST KNOWN MODE FOR CARRYING OUT THE INVENTION

Figure 1:
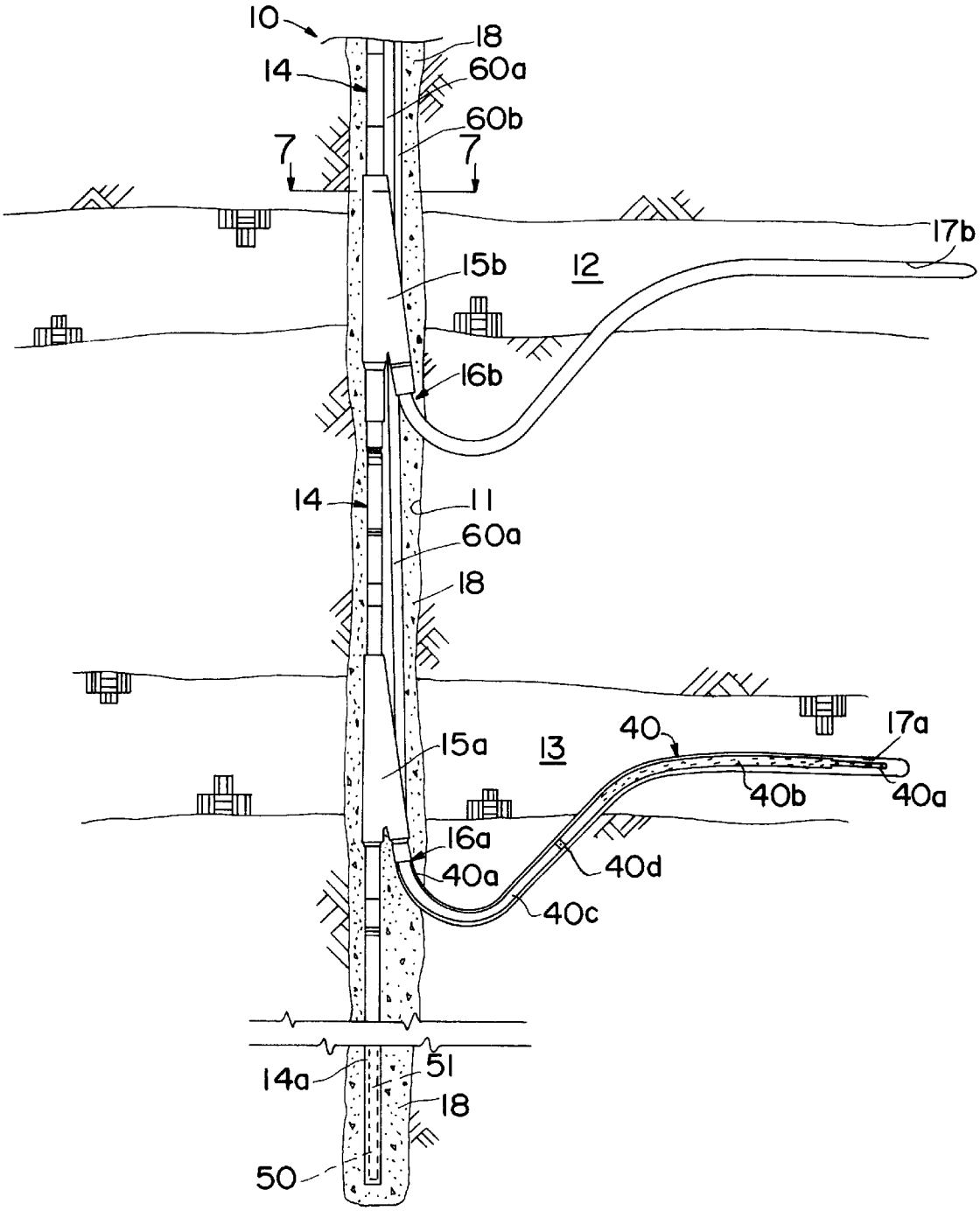
FIG. 1 is an elevational view, partly in section, of the lower end of a production well which has multiple lateral well bores drilled and completed in accordance with the present invention.

Referring more particularly to the drawings, FIG. 1 illustrates a well 10 which has been completed in accordance with the present invention. Well 10 has a relatively large (e.g. 18–20 inch), substantially vertical, primary wellbore 11 which passes through one or more subterranean production zones, e.g. formations 12, 13. It should be understood that the terms "vertical" and "horizontal", as used herein, are used as relative terms when used to describe the primary wellbore and the lateral wellbores and may actually include vertical or substantially vertical, horizontal or substantially horizontal, inclined, curved, etc. wellbores when such wellbore would otherwise be viewed in relation to the earth's surface.

Casing string 14 is made-up at the surface and is lowered into primary wellbore 11. The casing string includes one pre-formed window unit 15 for each lateral 17 to be drilled and completed from primary wellbore 11. A length of casing, e.g. one or more joints 14*a* of the same diameter or of slightly larger diameter extends below the lowermost pre-formed window unit 15*a* to serve as a fluid collection sump as will be further explained below.

Each pre-formed window unit 15 has basically the same construction as will be described in detail below and is assembled into the casing string 14 at spaced intervals so that each will lie adjacent the kick-off point 16 for its respective lateral 17 when casing 14 is properly positioned within wellbore 11. In accordance with an important aspect of the present invention, each unit 15 is positioned so that the kick-off point 16 for each lateral 17 will preferably lie at some distance (e.g. 50 feet) below the zone to be produced (e.g. 12, 13) for a purpose to be described below. Once the casing string 14 is in position within primary wellbore 11, it is cemented in place with cement 18 using conventional cementing techniques well known in the industry. Well 10 is now ready to be completed by drilling and completing laterals 17 from each of the respective pre-formed window units 15.

Referring now FIGS. 2–6, pre-formed window unit 15 is comprised of a housing 20 having a single inlet 21, which is connected into casing string 14, and two outlets 22, 23. A keyed landing sub 14*a* is connected at one end to outlet 22 and to casing string 14 at its other end so that there is a continuous flowpath formed throughout the length of casing 14 and pre-formed window units 15. The longitudinal axis 23*a* of the pre-formed window (i.e. outlet 23 through which a respective lateral 17 is drilled and completed) is off-set (see FIGS. 2) from the longitudinal axis 22*a* of outlet 22 at a small angle A for a purpose to be discussed below.

Figure 2:
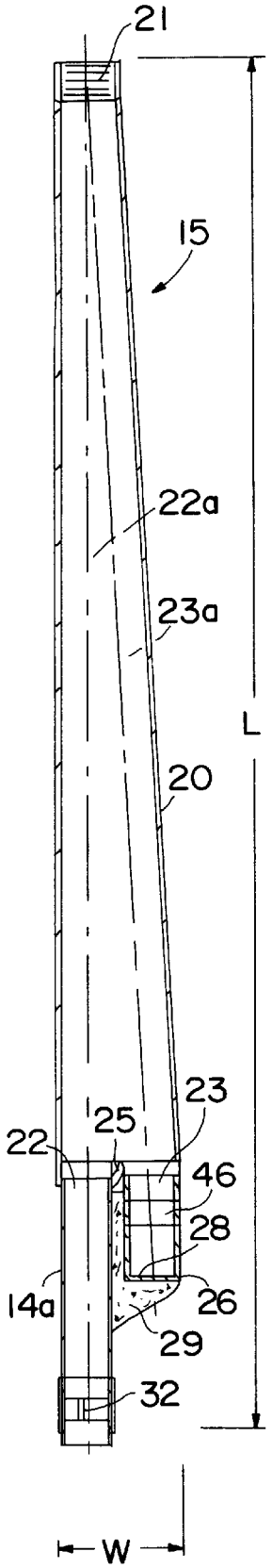
FIG. 2 is an elevational, sectional view of a pre-formed window unit in accordance with the present invention.
Figure 3:
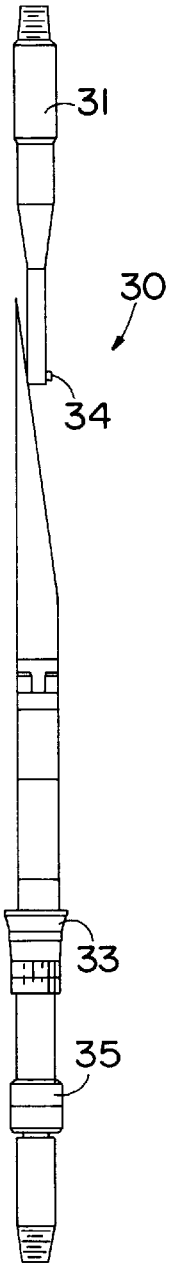
FIG. 3 is an elevational view of a diverter tool used in the present inventor.
Figure 4:
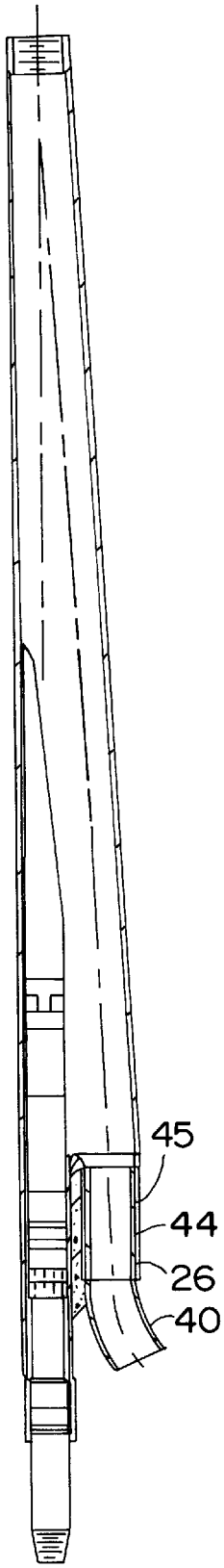
FIG. 4 is an enlarged elevational, sectional view of one of the pre-formed unit of FIG. 2 having the diverter of FIG. 3 positioned therein in an operable position.
Figure 9:
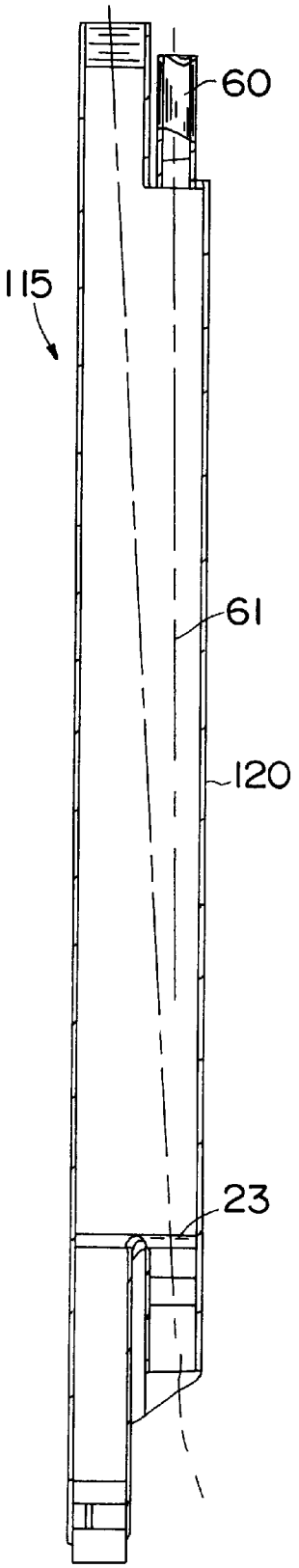
FIG. 9 is a sectional view of a further embodiment of the pre-formed window unit of the present invention.

The actual, outer configuration of housing 20 is not critical and can differ as long as it meets the following criteria. The size and shape of the outer perimeter of the housing must be such that casing string 14 can be readily lowered and cemented into primary wellbore 11 (see FIG. 7). Further, the length L (FIG. 2) must be long enough in relation to the effective width W of the housing so that the angle A formed before axes 22*a* and 22*b* will be small enough (i.e. from about 1° to about 10°, preferably 3°) to allow the drill string and subsequent completion liner to follow a gently curved path as it exits from housing 20 without forcing the respective well strings to undergo severe curvatures which, in turn, might damage the equipment or cause termination of the operations. The housing 20 may take the general shape of an inverted Y as shown in FIGS. 1, 2, and 4, or it can have a fairly uniform effective width along most of its length as shown in FIG. 9.

Figure 5:
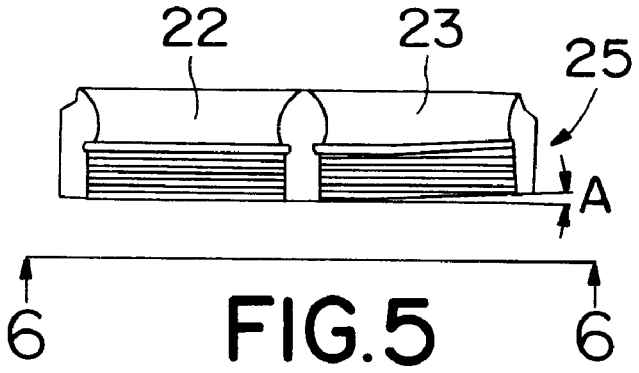
FIG. 5 is a sectional view of an element which forms the lower end of the pre-formed window unit of FIG. 2.
Figure 6:
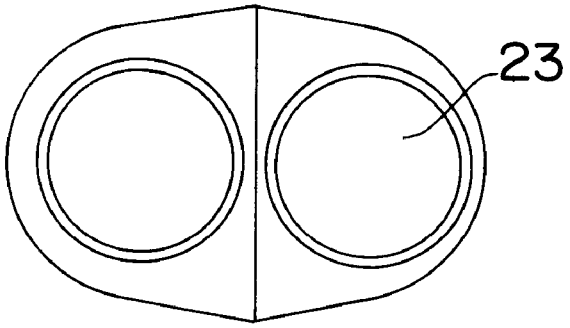
FIG. 6 is a bottom view taken along 6—6 of FIG. 5.

As illlustrated, outlets 22 and 23 are preferably formed by providing respective threaded openings through element 25 which, in turn, is attached to the lower end of housing 20 by welding or the like. As best seen in FIG. 5, element 25 is constructed so that the portion forming outlet 23 is offset from the other portion forming 22 by the same angle as A, so that the longitudinal axis 23*a* within housing 20 will extend through the center of window outlet 23 when element 25 is assembled into housing 20. This allows the longitudinal axis of liner connector sub 26 to align with longitudinal axis 23*a* when sub 26 is threaded or otherwise attached to window outlet 23 before casing 14 is lowered and cemented in the well.

To drill and complete a lateral(s) in accordance with the present invention, casing 14 is made-up at the surface as it is lowered into primary wellbore 11, using basically standard techniques commonly used in casing wellbores. At each point where a lateral is to be "kicked-off", a pre-formed window unit 15 is assembled into the casing string. Before a unit 15 is installed, however, the lower end of liner connector sub 26 is closed with cap 28 (FIG. 2) to prevent cement from entering the unit 15 during the cementing of casing string 14 in primary wellbore 11. Also, the lower end of liner connector sub 26 and the space between subs 14*a* and 26 are preferably encased in hardened cement 29 or the like to protect sub 26 during installation and to insure that the space between the subs will be filled with cement at the conclusion of the subsequent cementing operation.

Again, casing string 14 is lowered and positioned within primary wellbore 11 so that each kick-off point 16 for a lateral will lie below the production zone to be completed; i.e. kick-off point 16*a* will lie below formation 13, etc. After casing string 14 has been cemented in place using conventional cementing techniques, a diverter tool 30 (FIG. 3) is lowered through casing 14 on workstring 31. Since the lowermost lateral 17*a* is normally drilled and completed first, the diverter 30 is manipulated (i.e. rotated by workstring 31) so that key(s) (not shown) on keyed landing nut 35 will pass through the groove(s) 32 (FIG. 2) in landing sub 14*a* thereby allowing the diverter to pass through the landing sub 14*a* on upper pre-formed window unit 15*b* and continue on down casing 14 to lower pre-formed window unit 15*a*.

When the diverter reaches unit 15*a*, it is now again manipulated but this time it is to orient and land keyed landing nut 34 within keyed landing sub 14*a* of unit 15*a*. Diverter 30 has upper-facing packing cups 33 or the like thereon which form a temporary seal within landing sub 14*a* to prevent any debris from falling into the lower portion of casing string 14 during the drilling and completion of lateral 17. When the diverter 30 is properly positioned, pin 34 (FIG. 3) is sheared and workstring 31 is removed.

A drilling string (not shown) is now lowered and is diverted by the inclined surface 35 on diverter 30 into a gentle curvature (e.g. preferably about 3°) and out through window opening 23. Preferably, a conventional "bent sub" and downhole drilling motor (not shown) are used to drill lateral 17, as will be fully understood in the art. Lateral 17*a*, after being kicked-off in a gentle, downwardly inclined direction, is steered to curve upward into the producing zone (i.e. formation 13) after which the lateral is "straighten" out to extend substantially horizontal into the producing zone. After the lateral has been drilled, the drill string is then removed.

While the lateral could be produced "open-hole", it is preferred to complete the lateral by installing a completion liner or equivalent. As will be understood, different types of completion liners can be used. As illustrated, the completion liner 40 installed into lateral 17*a* is comprised of a length of small-diameter, perforated or slotted pipe 40*a*, a length of larger-diameter perforated or slotted pipe 40*b*, and a length of blank pipe 40*c*, which, in turn, extends substantially through that portion of the lateral which does not lie in the production zone. Port collars 40*d* may be included if needed for cementing the blank pipe in the lateral.

A connecting collar 44 (FIG. 4) is coupled to the top of liner 40 and is adapted to connect to and seal with liner connector sub 26 when liner 40 is in an operable position within lateral 17. Any type of an appropriate connecting means can be used; for example, as illustrated, an expandable, split ring 45 on collar 44 cams inwardly as it enters connector sub 26 and then expands into groove 46 (FIG. 2) to latch the liner in place. Also, sealing means (e.g. O-rings or the like, not shown for clarity) can be provided on connecting collar 44 which cooperate with the inner surface of sub 26 to provide a good seal between housing 20 of unit 15 and liner 40 to prevent leakage of fluids from lateral 17 in behind casing string 14 and cement 18.

Once lateral 17*a* has been completed, an "over-shot" tool (not shown) is lowered from the surface and over diverter 30 to cooperate with latch-ring 35 (FIG. 3) on the diverter to pick up and remove diverter 30. The diverter is raised and manipulated up through landing sub 14*a* of upper pre-formed window unit 15*b* after which it is lowered and again manipulated to land the diverter 30 in landing sub 14*a*. The over-shot tool is then released and the above-described operation is repeated to drill and complete lateral 17*b* from upper unit 15*b*.

When all of the laterals have been completed, a pump 50 is lowered through casing string 14 into the sump formed within the lower portion 14*a* of the casing string. While pump 50 can be a conventional electrically-driven, submersible pump or the like, it can also be a typical downhole pump suspended from a string of production tubing 51 and driven by a reciprocating string of sucker rods (not shown) which extend through the production tubing from the surface, as will be understood in the art.

Figure 8:
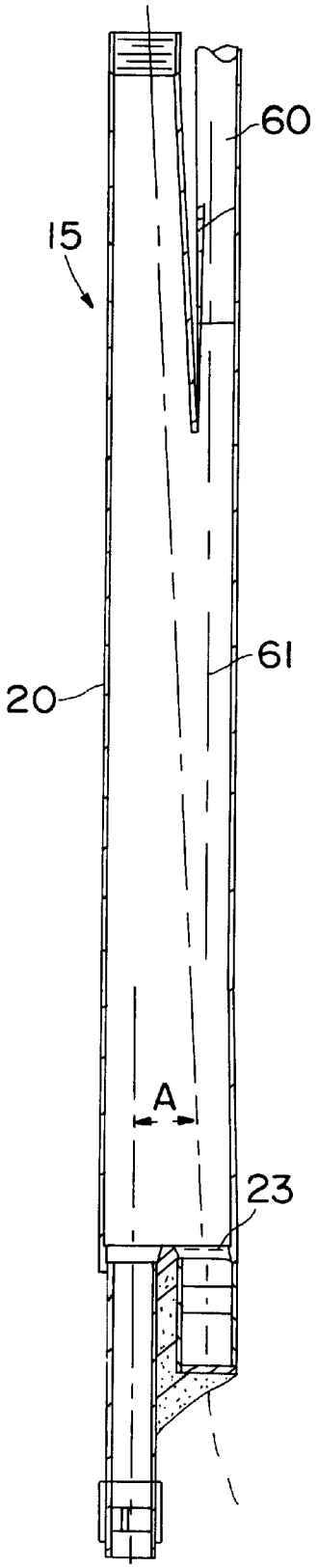
FIG. 8 is an enlarged, sectional view of the pre-formed window unit of FIG. 1 which includes a re-entry tubing.

In producing well 10, the fluids from each production zone flows through its respective lateral 17 and into casing 14 within primary wellbore 11. By positioning the "kick-off" point 16 (now the entry for the fluids into casing 14) below its respective production zone, the flow of fluids from the laterals is assisted by gravity. This can be of vital importance where the pressure differential between the production zone and the casing is small to induce flow through the U-shaped portion of the lateral. That is, in some instances (e.g. heavy oil production), the pressure differential between the production zone and the primary wellbore is too small to overcome the hydrostatic head which inherently exists within the U-shaped portion of the lateral if the entry into casing 14 was even with or above the point of entry into the lateral. The fluids from each lateral flow into and down casing string 14 where they are co-mingled in sump 14*a* from which they are then pumped by pump 50 to the surface through tubing 51.

Where multiple laterals are to be completed from a single primary wellbore as described above, it is desirable to have the capability to reenter an individual lateral for work-over operations without first having to shut-in the production through the other laterals. This allows partial production to be continued while the selected lateral is being worked over. In accordance with an important aspect of the present invention, this is accomplished by connecting an individual re-entry line 60 (FIGS. 1, 8, 9) to each pre-formed window unit 15 before casing string 14 is lowered into the primary wellbore 11. The re-entry lines 60 are cemented in place along with casing 14 and are available when needed. FIG. 8 shows a re-entry line 60 attached to a pre-formed window unit 15 having a Y-shaped housing 20 while FIG. 9 shows a re-entry line 60 attached to a pre-formed window unit 115 having a housing 120 of a slightly different configuration.

Figure 7:
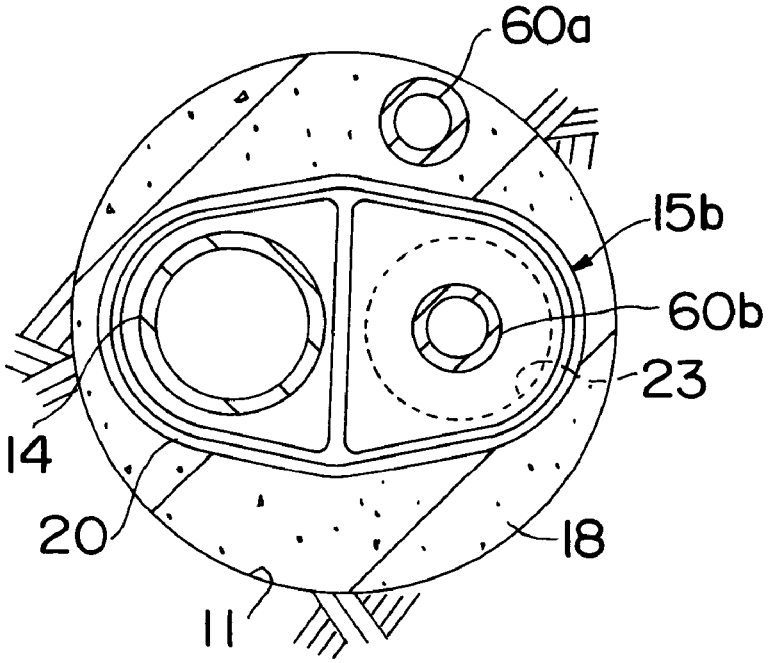
FIG. 7 is an enlarged, cross-sectional view taken along line 7—7 of FIG. 1.

Each re-entry line 60 is positioned in relation to its respective housing 15 so that the longitudinal axis 61 (FIGS. 8 and 9) of the re-entry line will extend substantially through the center of outlet exit opening 23 where the line is attached to the housing. As best seen in FIGS. 1 and 7, where more than one pre-formed window unit 15 is incorporated into the casing string 14, the re-entry line 60*a* to lower pre-formed window unit 15*a* can be run substantially parallel with re-entry line 60*b* from the surface and then curved slightly to by-pass around upper unit 15*b* to continue on to lower unit 15*a*.

It can be seen, that a production log can be run or a work-over tool, e.g. jet nozzle on a string of coiled-tubing (not shown), can be lowered through an individual re-entry line and into a selected, individual lateral without having to lower and land a diverter within casing string 14. By not having to block the casing with a diverter, pump 50 and production tubing 51 does not have to be removed from the well (nor replaced when the work-over operation is completed) so production can continue from the other laterals while the selected lateral is being re-worked.

To further illustrate the present invention, the following, non-limiting example is set forth. A primary wellbore 11 having a diameter of 18–20 inches is drilled to a total depth of about 3000 feet and passes through two producing zones 12, 13 which are approximately 100 feet apart. A casing string 14 comprised of joints of 7-inch diameter casing is made-up at the surface as it is lowered into the primary wellbore. As the casing is made-up and lowered, two pre-formed window units 15*a*, 15*b* are incorporated (i.e. threaded) into the casing string at spaced intervals so that each unit will lie adjacent the kick-off point of a respective lateral which is to be drilled through that window unit. Again, these units are positioned within casing 14 so that the kick-off point, i.e. pre-formed window, will lie below the zone to be completed (e.g. about 50 feet) when the casing is in its operable position within the primary wellbore.

Each housing 15 will have a relatively long length L of about 18–20 feet when compared to a width W of 16.5 inches whereby the angle A formed between the axes 22*a* and 23*a* will be small, i.e. about 3°. Inlet 21 and both outlets 22, 23 are about 7 inches in diameter and are threaded to receive landing sub 14*a* and liner connector sub 26 (about 3 feet long), respectively. A diverter 30 having an approximately 3° inclined surface thereon is lowered and is manipulated to pass through the upper landing sub 14*b* and be landed and oriented in lower landing sub 14*a*.

A conventional coiled-tubing drill string (not shown) having a 2⅞ inch bent (±3°) housing, downhole motor with a 3.75 inch OD diamond bit is lowered through casing string 14 and is diverted out through completion liner sub 26 to drill lateral 17*a* as will be understood in the art. The total displacement from the primary well 11 is about 1500 feet with about 1150 feet being substantially horizontal within producing zone 13. The drill is then removed to the surface and liner 40 is lowered and deflected by diverter 30 out through liner sub 26 and into lateral 17*a*.

A typical liner might be made-up of a lead section 40*a* of 150 feet of 3½ inch diameter slotted pipe, an intermediate section 40*b* of about 1000 feet of 4½ inch diameter slotted pipe, and a remaining blank section 40*c* of 4½ inch blank pipe, which, in turn, is cemented in place with a fiber cement through ports 40*d*. A conventional overshot is then lowered to engage diverter 30 to raise and land the diverter in landing sub 14*b* of the upper pre-formed window unit 15*b*. The above procedure is then repeated to drill and complete lateral 17*b*.

What is claimed is:

1. Apparatus for drilling and completing a lateral wellbore from a primary wellbore, said apparatus comprising:

a casing string adapted to be lowered in said primary wellbore;

at least one pre-formed window unit in said casing string, said at least one pre-formed window unit comprising:

an elongated housing having an inlet at its upper end and two outlets at its lower end, said inlet being fluidly connected to the lower end of that portion of said casing string which extends above said housing;

a landing sub connected at one end to a first of said outlets and at its other end to the upper end of that portion of said casing string which extends below said housing, whereby said inlet, said first outlet, and said landing sub provide for continuous flow through said casing string;

the other of said outlets providing a pre-formed window for drilling and completing said lateral wellbore from said primary wellbore wherein the longitudinal axis which extends through the center of said first outlet lies on or is substantially parallel to the longitudinal axis of said casing string while the longitudinal axis extending through the center of said second outlet forms a relatively small angle with respect to the longitudinal axis of said first outlet, said angle being equal to from about 1° to about 10°.

2. The apparatus of claim 1 wherein said relatively small angle is equal to about 3°.

3. The apparatus of claim 1 including:

a re-entry line in fluid communication with said housing and adapted to extend to the surface, the effective longitudinal axis of said re-entry line in substantial alignment with the center of said other outlet when said string of casing and said re-entry line are in an operable position within said primary wellbore.

4. The apparatus of claim 1 including:

a liner connector sub connected to said other outlet and having means for receiving and latching a completion liner thereto.

5. The apparatus of claim 1 including:

a diverter releasably landed in said landing sub in said housing and adapted to deflect a well string through said other of said outlets.

6. The apparatus of claim 1 wherein the lower end of said casing string is adapted to form a sump for fluids produced into said primary wellbore.

7. The apparatus of claim 1 wherein said at least one pre-formed window unit comprises:

a plurality of pre-formed window units spaced along said casing string.

* * * * *